US006075321A

United States Patent [19]

Hruby

[11] Patent Number: 6,075,321

[45] Date of Patent: Jun. 13, 2000

[54] HALL FIELD PLASMA ACCELERATOR WITH AN INNER AND OUTER ANODE

[75] Inventor: Vladimir J. Hruby, Newton, Mass.

[73] Assignee: Busek, Co., Inc., Natick, Mass.

[21] Appl. No.: 09/107,343

[22] Filed: Jun. 30, 1998

[51] Int. Cl.[7] ..... H01J 27/02

[52] U.S. Cl. ..... 315/111.91; 315/111.61; 60/202; 313/359.1

[58] Field of Search ..... 315/111.61, 111.81, 315/111.91; 60/202; 313/359.1

[56] References Cited

U.S. PATENT DOCUMENTS

| | | | |
|---|---|---|---|
| 4,937,456 | 6/1990 | Grim et al. | 315/111.81 X |
| 5,177,761 | 1/1993 | Kaiser et al. | 372/61 |
| 5,218,271 | 6/1993 | Egorov et al. | 315/111.61 |
| 5,359,254 | 10/1994 | Arkhipov et al. | 313/15 |
| 5,359,258 | 10/1994 | Arkhipov et al. | 313/359.1 |
| 5,475,354 | 12/1995 | Valentian et al. | 335/296 |
| 5,509,266 | 4/1996 | Morozov et al. | 60/203.1 |
| 5,581,155 | 12/1996 | Morozov et al. | 315/111.21 |
| 5,689,950 | 11/1997 | Smith | 60/202 |
| 5,763,989 | 6/1998 | Kaufman | 315/111.91 |

FOREIGN PATENT DOCUMENTS

| | | | |
|---|---|---|---|
| 0 463 408 A2 | 6/1991 | European Pat. Off. . | |
| 0 541 309 B1 | 10/1992 | European Pat. Off. . | |
| 0 541 309 A1 | 1/1995 | European Pat. Off. . | |
| 637689 | 2/1995 | European Pat. Off. | 60/202 |
| 0 778 415 A1 | 6/1997 | European Pat. Off. . | |
| 0 784 417 A1 | 7/1997 | European Pat. Off. . | |
| 0 800 196 A1 | 10/1997 | European Pat. Off. . | |
| 0 800 197 A1 | 10/1997 | European Pat. Off. . | |
| WO 97/37126 | 3/1997 | WIPO . | |
| WO 97/37127 | 3/1997 | WIPO . | |
| WO 97/37517 | 3/1997 | WIPO . | |

OTHER PUBLICATIONS

Bugrova et al., Physical Processes and Characteristics of Stationary Plasma Thrusters With Closed Electrons "Drift", 22d International Electric Propulsion Conference, Viareggio, Italy, Oct. 3, 1991.

Morozov et al., "Effect of the Magnetic Field on a Closed Electron–Drift Accelerator" Soviet Physics–Technical Physics, vol. 17, No. 3 (Sep. 1972).

Morozov et al., "Plasma Accelerator With Closed Electron Drift and Extended Acceleration Zone" Soviet Physics–Technical Physics, vol. 17, No. 1 (Jul., 1972).

Garner et al., "Evaluation of 4.5–kW D–100 Thruster With Anode Layer", 32nd AIAA/ASME/SAE/ASEE Joint Propulsion Conference, Lake Buena Vista, FL Jul. 1–3, 1996.

Gallimore et al., "Preliminary Characterization of a Low Power End–Hall Thruster", 30th AIAA/ASME/SAE/ASEE Joint Propulsion Conference, Indianapolis, IN, Jun. 27–29, 1994.

Sankovic et al., "Operating Charcteristics of the Russian D–55 Thruster withAnode Layer", 30th AIAA/ASME/SAE/ASEE Joint Propulsion Conference, Indianapolic, IN, Jun. 27–29, 1994.

Marrese et al., "Analysis of Anode Layer Thruster Guard Ring Erosion", International Electric Propulsion Conference, Moscow Russia, Sep. 19–23, 1995.

Cordero, , Julio, Problem Solving Report Plasma Accelerators, Electron Drift, and Closed—Patents, NERAC Inc., 1997.

*Primary Examiner*—Justin P. Bettendorf
*Attorney, Agent, or Firm*—Iandiorio & Teska; Brian J. Colandreo

[57] ABSTRACT

A Hall field plasma accelerator with closed electron drift includes a composite anode including a housing with inner and outer walls which form an outer anode and an inner anode forming inner and outer distribution zones; the housing is electrically conductive and has an upstream end and an exit port electrically insulated from the housing; the composite anode includes an input distribution system for introducing plasma gas into the distribution zones; poles establish a magnetic field across the exit port and a cathode establishes an electron flow through the magnetic field toward the composite anode and creates an electric field through the exit port; the electrons ionize the plasma gas that is accelerated by the electric field through the exit port.

38 Claims, 5 Drawing Sheets

HALL FIELD PLASMA ACCELERATOR WITH AN INNER AND OUTER ANODE

FIELD OF INVENTION

This invention relates to an improved Hall field plasma accelerator.

BACKGROUND OF INVENTION

Hall field plasma accelerators (or thrusters) with closed electron drift employ electrons discharged from a separate cathode and directed toward an anode by an applied electric field (E) through an applied magnetic field (B) which is generally orthogonal to the applied electric field and in which the electrons collide with atoms of a gas or propellant to create a plasma which consists of approximately equal number of electrons and ions which are accelerated out of the accelerator/thruster by the applied electric field. Generally the Larmor radius $\rho_e$ of the electrons is much smaller than the characteristic length L of the accelerator so the electrons tend to move in a helical path about the magnetic lines as they move from line to line azimuthally and drift generally toward the anode. The ions in contrast have a Larmor radius $\rho_i$ which is much greater than the characteristic length L so the path of the ions is largely unaffected by the magnetic field.

The thrust and power density of the accelerator increases with increasing mass flow rate of the plasma gas. The upper limit on the mass flow rate is set by the requirement to minimize the number and frequency of collisions between ions and neutral atoms. Such collisions are undesirable because they thermalize the plasma and divert the accelerating ions from their primary path, causing some of them to strike the containment walls which leads to wall heating and sputtering, all contributing to a loss of efficiency and reduction of accelerator life. The mean distance an ion travels before colliding with a neutral atom is known as its mean free path $\lambda_{in}$. It is proportional to 1/(nQ) where n is the number of atoms per unit volume and Q their collisional cross-section. To minimize the number of collisions it is required to have the characteristic length L smaller than the mean free path.

Thus if an accelerator or thruster can be made with a very small characteristic length L, $\lambda_{in}$ can be made concomitantly smaller so that n can be increased. More atoms per unit volume (n) generally means more ions and thus more power from a smaller device.

One construction known as a thruster with anode layer (TAL) has a very short acceleration zone: the characteristic length L is short so it has a high number n and operates at high power density. Because of the high power density which generally results in high heat loads the anode is typically made of materials such as graphite or high melting point metals to withstand the elevated temperature. In another construction, a stationary plasma thruster (SPT), the characteristic length L is much larger because the anode is set deep within its dielectric discharge chamber. Since the length L is greater it must have a lower n and so operates at a lower power density.

Separately, plasma physics equations dictate that in coexisting mutually orthogonal electric and magnetic fields, the magnetic field lines approximate the equipotential contours in the plasma. This relationship of equipotentials and magnetic field lines is distorted by the presence of electric and/or magnetic conductors. Thus in the SPT type of device, for example, the fringing magnetic field dictates the electric field distribution within the plasma which may create undesirable ion trajectories leading to reduced performance, diverging ion beams and reduced lifetime. In the TAL type device the consequences of Maxwell's equations and small L results in high energy electrons impacting the anode.

SUMMARY OF INVENTION

It is therefore an object of this invention to provide an improved Hall field plasma accelerator or plasma thruster.

It is a further object of this invention to provide such an improved plasma accelerator or plasma thruster which provides better focusing of the ion trajectories.

It is a further object of this invention to provide such an improved plasma accelerator or plasma thruster which reduces the energy of electrons striking the composite anode.

It is a further object of this invention to provide such an improved plasma accelerator or plasma thruster which has more azimuthally uniform propellant distribution.

It is a further object of this invention to provide such an improved plasma accelerator or plasma thruster which has more radially controllable propellant distribution.

It is a further object of this invention to provide such an improved plasma accelerator or plasma thruster with higher probability of propellant ionization.

It is a further object of this invention to provide such an improved plasma accelerator or plasma thruster having higher probability of ionization by secondary electrons.

It is a further object of this invention to provide such an improved plasma accelerator or plasma thruster with better control of magnetic field fringing and shaping.

It is a further object of this invention to provide such an improved plasma accelerator or plasma thruster having better heat rejection.

It is a further object of this invention to provide such an improved plasma accelerator or plasma thruster with better control of the electric field in the presence of the magnetic field.

It is a further object of this invention to provide such an improved plasma accelerator or plasma thruster which has higher power density.

The invention results from the realization that a more efficient, high performance plasma accelerator with closed electron drift can be achieved by using a composite anode including an electrically conductive housing with inner and outer walls and an inner anode whose exit port is electrically insulated from the housing and the inner anode extends through the housing toward the exit port to create equipotential surfaces and reduced electric field near the upstream end of the exit port.

This invention features a Hall field plasma accelerator with closed electron drift. There is a composite anode including a housing with inner and outer walls forming an outer anode and an inner anode forming inner and outer distribution zones. The housing is electrically conductive and has an upstream end and an exit port electrically insulated from the housing. The composite anode includes an input distribution system for introducing plasma gas into the distribution zones. Pole means establish a magnetic field across the exit port. A cathode establishes an electron flow through the magnetic field toward the composite anode and creates an electric field through the exit port. The electrons ionize the plasma gas that is accelerated by the electric field through the exit port.

In a preferred embodiment, the inner anode and the housing may be electrically connected. The inner anode and the housing may be insulated from each other. The inner anode and the housing may be at different electric potentials. The distribution system may include a first plurality of input ports in the inner anode and a first number of radial channels extending from the input ports. The distribution system may include at least one input port in a housing communicating with the first plurality of input ports. The inner anode may have a central recess facing the exit port with a second number of radial channels extending outwardly recessed through the inner anode. The base of the inner anode may be spaced from the base of the housing creating a plenum therebetween and the housing may include at least one input port for introducing plasma gas into the plenum. The radial channels may be blocked at one end or conically tapered to narrow at one end, or stepped to narrow at one end. The housing and the inner anode may extend proximate to the exit port for establishing equipotential surfaces within the plasma for defining initial ion trajectories. The housing and the inner anode member may extend proximate to the exit port for establishing equipotential surfaces within the plasma for defining a low electric field zone near and beyond the downstream end of the inner anode for reducing the energy of impinging electrons. The exit port may be made of dielectric material or alternate layers of dielectric and conductive material. The exit port may include a sputter resistant material for protecting the pole means. The sputter resistant material may be diamond or graphite. The housing, the exit port and the pole means may be thermally connected for improved heat rejection. The housing may be thermally isolated from the exit port to minimize input gas heating. The housing may have a width equal to or larger than the exit port for providing a reservoir of propellant, greater uniformity of propellant distribution and more uniform plasma for improved life performance and reduced discharge fluctuations. The housing and the inner anode may extend proximate to the exit port for establishing equipotential surfaces within the plasma and a low electric field zone near and beyond the downstream end of the inner anode for inducing the electrons to traverse the paths of neutrals to increase probability of collision and enhance ionization. At least parts of the housing may be made of magnetic material for shunting fringing portions of the magnetic field and controlling the magnetic field distribution in the plasma for improved performance and life. The housing may be in electrical contact with the plasma gas. The exit port and the pole means may be in physical contact. There may be a magnetic field source for providing a magnetic field through the poles. The composite anode may be annular and the magnetic field source may be disposed radially outwardly of the composite anode, or radially inwardly of the composite anode, or radially inwardly and radially outwardly of the composite anode. The composite anode and the exit port may be circularly annular or non-circularly annular. The exit port may be chamfered to reduce initial sputtering.

DISCLOSURE OF PREFERRED EMBODIMENT

Other objects, features and advantages will occur to those skilled in the art from the following description of a preferred embodiment and the accompanying drawings, in which.

Figure 1A:
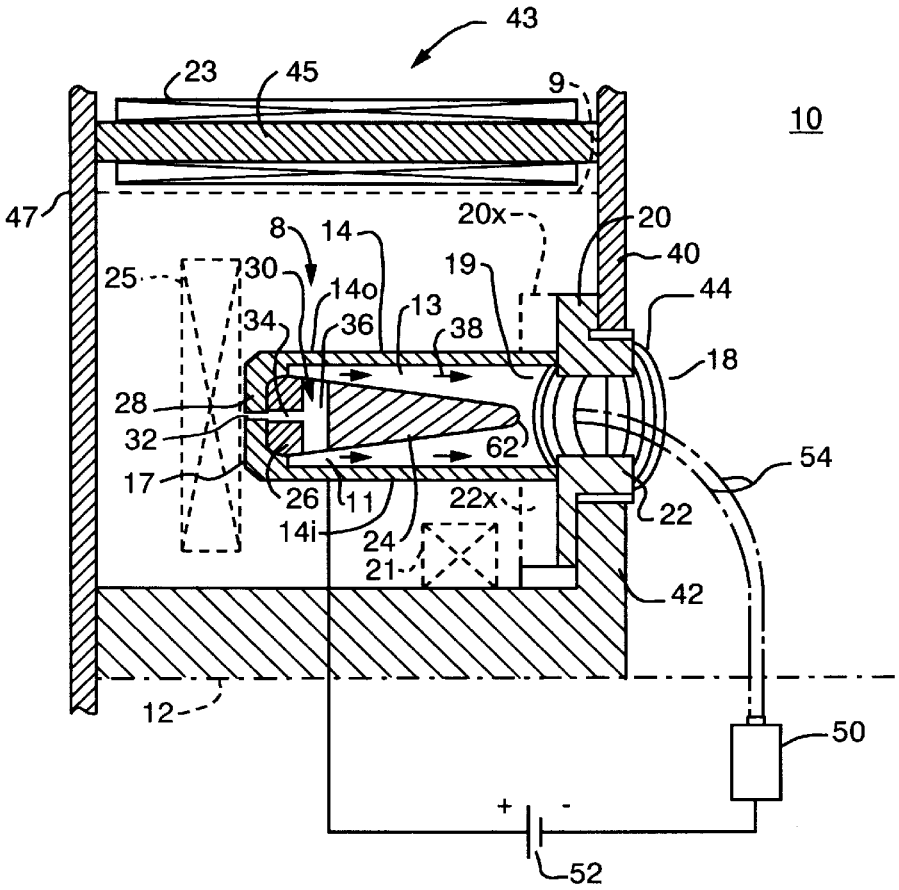
FIG. 1A is a schematic cross-sectional view along lines 1A—1A of FIG. 1B of a portion of a plasma accelerator according to this invention which is circularly symmetrical about its center line.
Figure 1B:
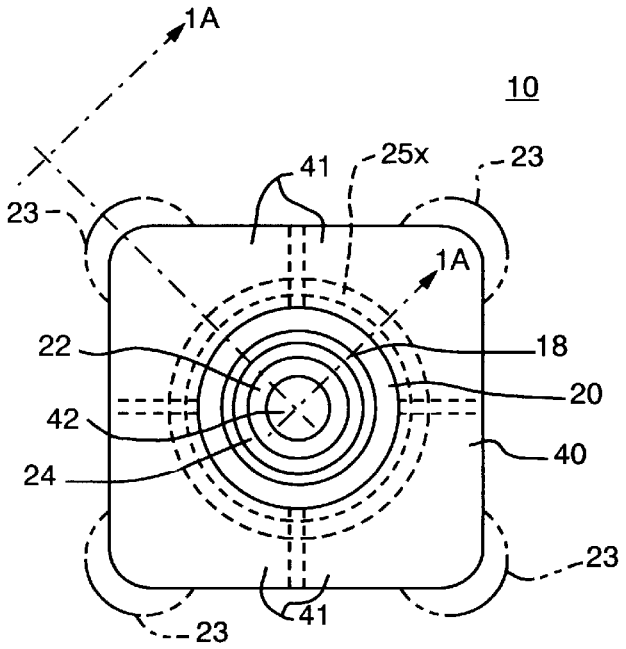
FIG. 1B is a front diagrammatic view of the plasma accelerator of FIG. 1A.

There is shown in FIGS. 1A and 1B a plasma accelerator or thruster 10 according to this invention in simplified form and circularly symmetrical about center line axis 12. Thruster 10 includes a composite anode 8 including annular housing 14 having outer and inner walls $\mathbf{14}_o$ and $\mathbf{14}i$ and inner anode 24 all made of electrically conductive material.

Housing 14 includes an upstream end 17 and annular exit port 18 formed of two insulating dielectric rings 20 and 22. Inner anode 24, shown elongated and tapered in FIG. 1A, has its base 26 mounted directly to the base 28 of housing 14 and creates two radially separate zones 11, 13 for directing the plasma gas toward exit port 18. Housing 14, exit port 18 including rings 20, 22, and annular pole pieces 40 and 42 may all be thermally interconnected for providing increased heat rejection and improved life or the housing 14 may be thermally isolated to minimize propellant heating thereby increasing its residence time and probability of ionization. In one embodiment, rings 20 and 22 may be formed wholly of diamond or may be a deposited diamond layer on e.g., boron nitride. Diamond has superior thermal and wear characteristics (sputtering resistance) and is electronegative which minimizes loss of electrons and their energy to the walls. The dielectric exit rings 20, 22 can be chamfered at the two exit ends or can be straight.

Figure 2:
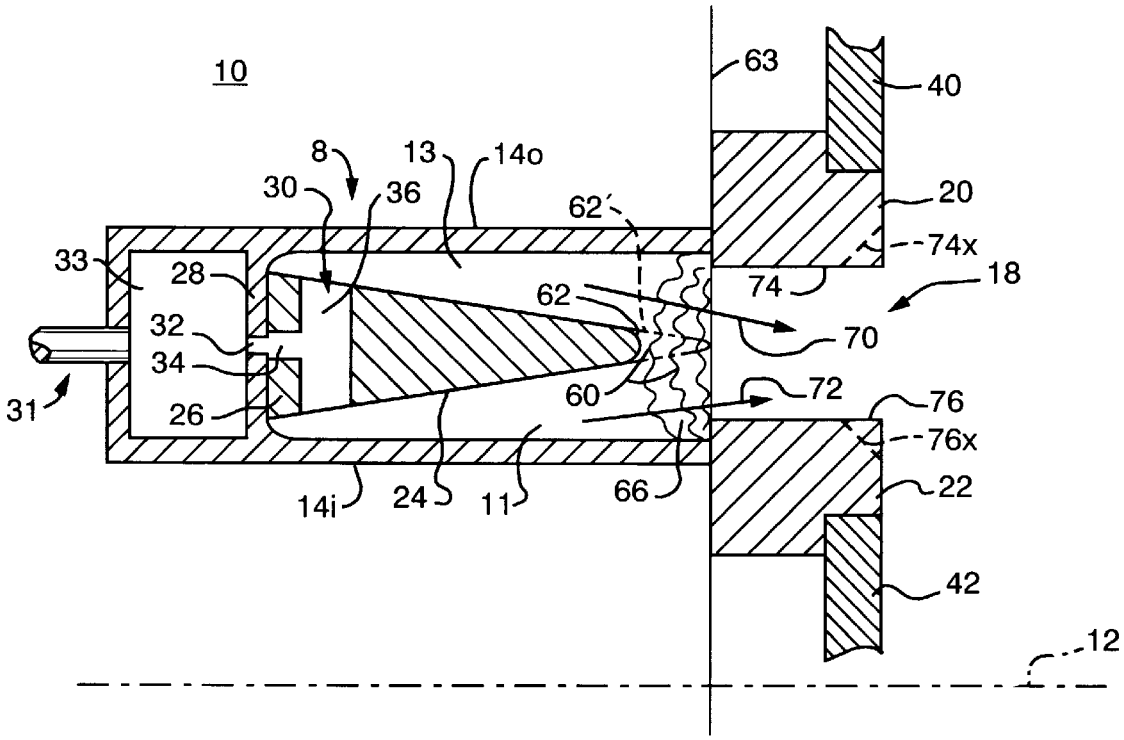
FIG. 2 is a more detailed schematic view of a portion of the device shown in FIG. 1 illustrating the equipotential region and initial ion trajectories resulting therefrom.

Chamfering the exit rings 20, 22, as shown at 74*x* and 76*x*, FIG. 2, reduces the amount of sputtered exit ring material that may be deposited on the spacecraft.

The axial distance between inner anode 24 downstream end and the upstream end of the exit rings 20 and 22 is typically much shorter than the radial gap between the exit rings 20 and 22. However, the axial distance between the downstream end of housing 14 and the downstream end of exit rings 20, 22 is typically smaller than the radial gap between exit rings 20, 22. For example, the downstream end 62 of inner anode 24, FIGS. 1A and 2, may extend to the vicinity of plane 63, FIG. 2, as shown in phantom at 62'. Dielectric rings 20 and 22 may be as shown in phantom at 20*x* and 22*x*, FIG. 1A, but can be made shorter as at 20 and 22 without decreasing performance because according to the invention, the electrically and/or magnetically conductive composite anode including housing 14 can modify the effect or shape of the magnetic field profile; the inner anode remains in an area with low local electric field. In addition, although the walls $14_o$ and $14_i$ of housing 14 are shown of equal length, this is not a requirement of the invention: they may be unequal in length, either one being the longer. Housing 14 may have a width equal to or larger than that of exit port 18 for creating a propellant reservoir 19 to provide greater uniformity of propellant distribution and more uniform plasma for improved performance and reduced discharge fluctuations. Poles 40, 42 connect with the magnetic circuit 43 including outer magnetic core 45 of coil 23 and back flange 47.

The propellant, a gas such as xenon for space propulsion or argon for terrestrial applications as an example, is delivered to the distribution system 30 through one or more channels 32 in housing 14. Distribution system 30 includes a number of input ports 34 which communicate with larger diameter radial passages 36 from which the propellant flows into gas distribution zones 11 and 13 and toward exit port 18 as indicated by arrows 38. Pole pieces 40, 42 direct the magnetic field flux B 44 across exit port 18. An electric field E exists between cathode 50 and composite anode 8 by virtue of a power source 52. The cathode 50 can be located near the accelerator outside perimeter or in case of larger thrusters, the inner pole piece 42 can be made hollow with the cathode 50 located within it. This improves the thruster/volumetric packaging and cathode to thruster plasma coupling. Electrons 54 emitted from cathode 50 flow from cathode 50 through magnetic field B 44 in aperture 18 to composite anode 8. While electrons generally move toward the composite anode 8, locally, they spiral around the magnetic field lines in accordance with their Larmor radius and drift as they move azimuthally in the annular exit port 18 moving from magnetic field line to magnetic field line toward the composite anode 8 in general and the inner anode 24 in particular. To prevent electrons streaming toward the external surfaces of the composite anode 8, the composite anode 8 may be enclosed in an electron screen 9 or in a dielectric material such as BN.

The magnetic field source may be a permanent magnet or electromagnet 21, FIG. 1A, located radially inwardly of composite anode 8 or one or more permanent magnets or electromagnets 23, FIG. 1B, located radially outwardly of composite anode 8, or both. Or there may be a magnetic source 25 located upstream of housing 14, FIG. 1A or radially outwardly of the housing 14 but coaxial with it as shown at 25*x*. Pole piece 40 may be made in one or more sections 41.

Figure 1C:
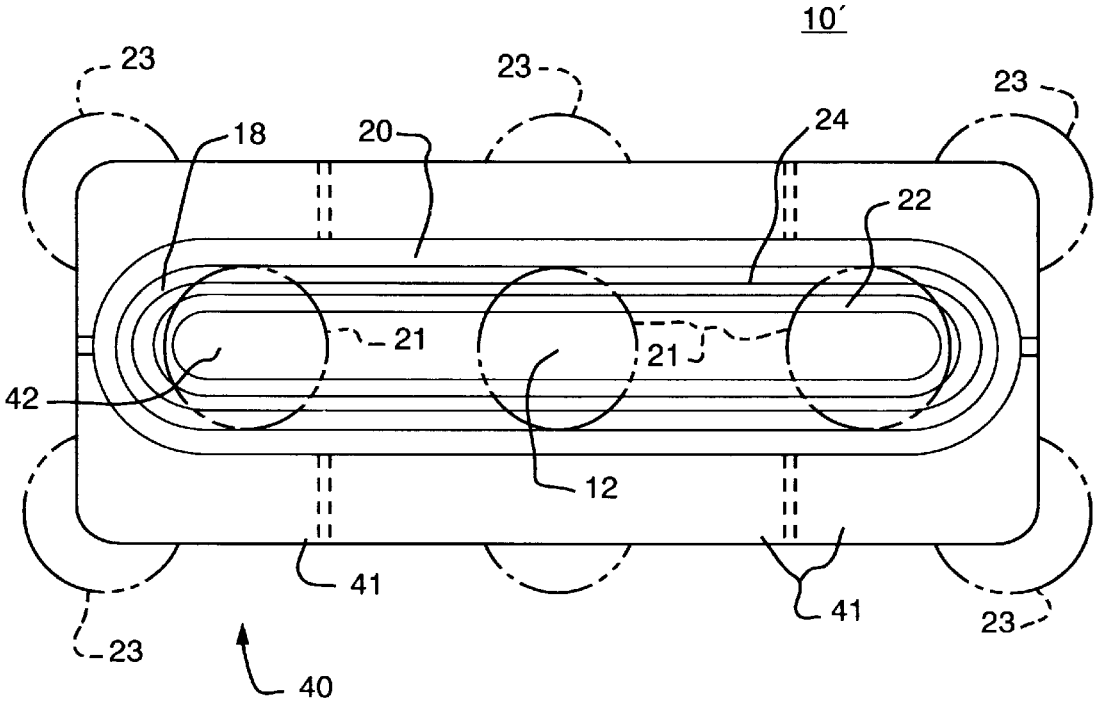
FIG. 1C is a view similar to FIG. 1B of a non-circular plasma accelerator according to this invention.

Although for ease of understanding plasma accelerator 10 has been shown as circularly symmetrical about a central axis, this is not a necessary limitation of the invention. For example, the invention contemplates many non-circular shapes, one of which is shown in FIG. 1C.

Figure 3:
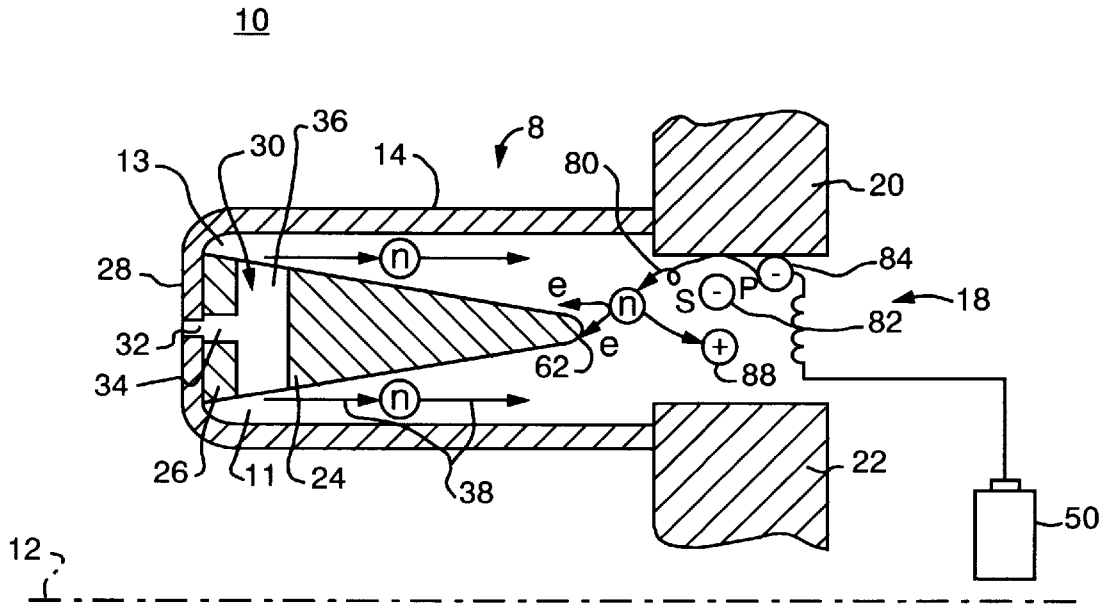
FIG. 3 is a view similar to FIG. 2 illustrating the path of secondary emission electrons transverse to the path of the propellant neutrals or atoms.

Conductive housing 14 creates equipotential regions 60, FIG. 2, in the area proximate the downstream end 62 of inner anode 24 and the inner area 66 of exit port 18. The magnetic lines of magnetic field B 44 have been omitted in FIG. 2 for purposes of clarity. The initial trajectory of the ions 70, 72 is generally perpendicular to the equipotentials in regions 60. The plasma potential along any and all magnetic field lines that intersect the electrically conductive housing 14 is approximately constant and defined by the potential of the housing 14. Since those equipotentials are more nearly flat in the area near the downstream end 62 of inner anode 24, the trajectories of the ions 70, 72 clear exit port 18 without striking the inner surfaces 74 and 76, which would cause deleterious effects such as wear and heating and detract from the life and the efficiency of the plasma accelerator. The close proximity of downstream end 62 of inner anode 24 also provides a path 80, FIG. 3, for secondary electrons 82 emitted from exit port 18, rings 20 and 22, when the rings 20, 22 are struck by primary electrons 84, so that path 80 is more nearly transverse to the flow of the neutrals or atoms of the propellant and thereby increases the likelihood of collision between the secondary electrons and the neutral atoms to create more ions 88. An input manifold 31 with plenum 33 feeds at least one input port 32 which supplies one or more of input ports 34.

Figure 4:
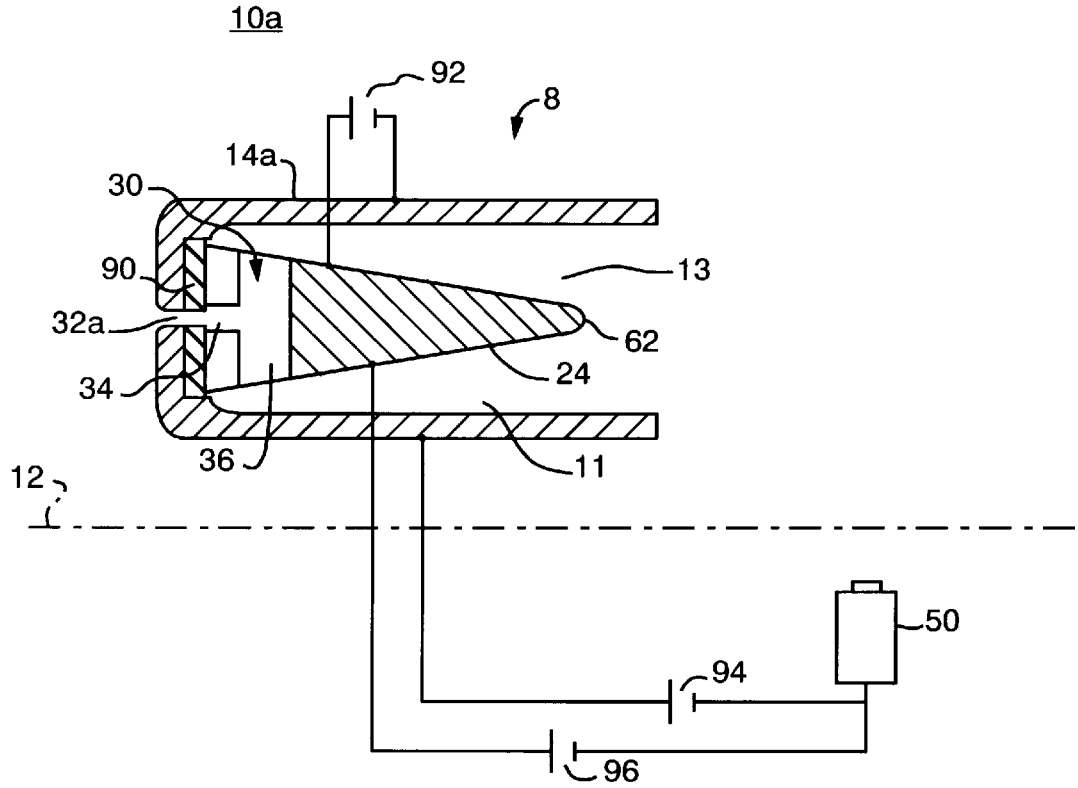
FIG. 4 is a simplified schematic view showing the various electric potential schemes that can be applied between the inner anode and conductive housing of the plasma accelerator according to this invention.

Although thus far the inner anode 24 and housing 14 are shown electrically connected and at the same potential, this is not a necessary limitation of the invention. For example, as shown in the simplified schematic of FIG. 4, inner anode 24 may be mounted on an insulator member 90 in housing 14*a*. Then inner anode 24 may be set at a different potential than housing 14*a* by a potential source such as battery 92 or the housing 14*a* and inner anode 24 may be set at different potentials by sources 94 and 96. Whether or not housing 14 is in electrical contact with inner anode 24, housing 14 is in contact with the plasma gas.

Figure 5:
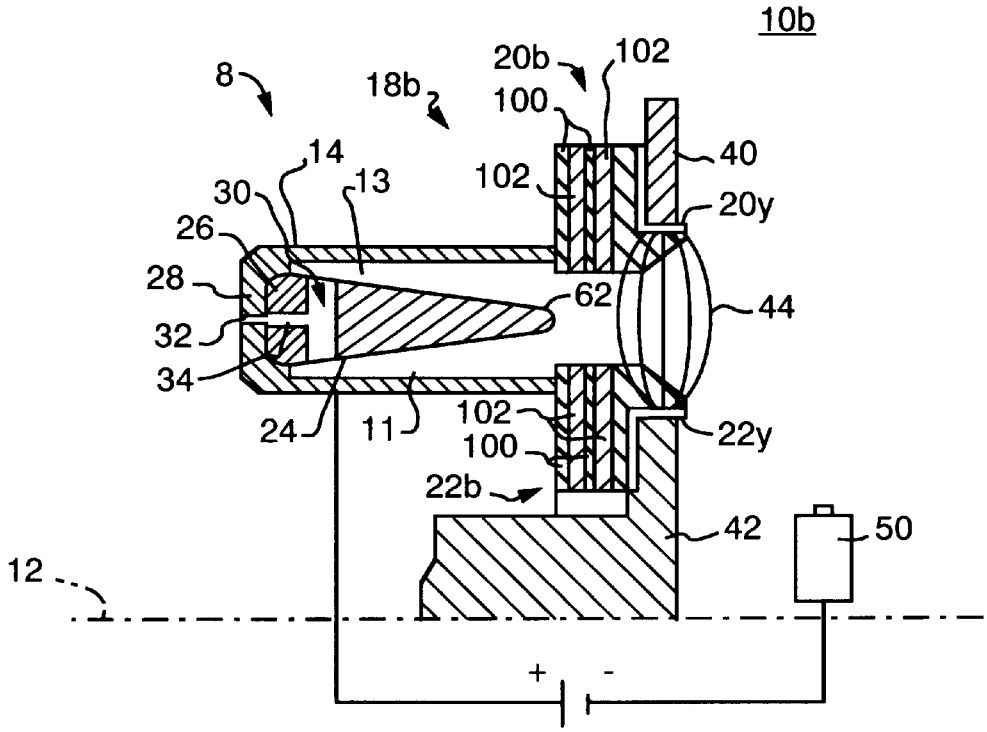
FIG. 5 is a view similar to FIG. 1 showing the exit port formed from laminated rings having alternate sections of insulators and conductors and also shows a protective layer over the poles made of sputter resistant material.

Although exit port 18 is shown formed of dielectric or insulator rings 20 and 22, this is not a necessary limitation of the invention. For example, rings 20*b*, 22*b* of exit port 18*b*, FIG. 5, may be formed of alternate layers of electrically insulating material 100 and conductor material 102. The exit rings 20, 22 made, for example, of boron nitride, may erode near the end of thruster life, leaving the downstream portion of the magnetic poles 40, 42 exposed to sputtering. To preserve the shape of the poles 40, 42 they may be protected by a layer 20*y*, 22*y* of highly sputter resistant material such as graphite or diamond placed over the poles 40, 42 or imbedded in the exit rings 20, 22. This forms a radially and axially layered structure.

Figure 6:
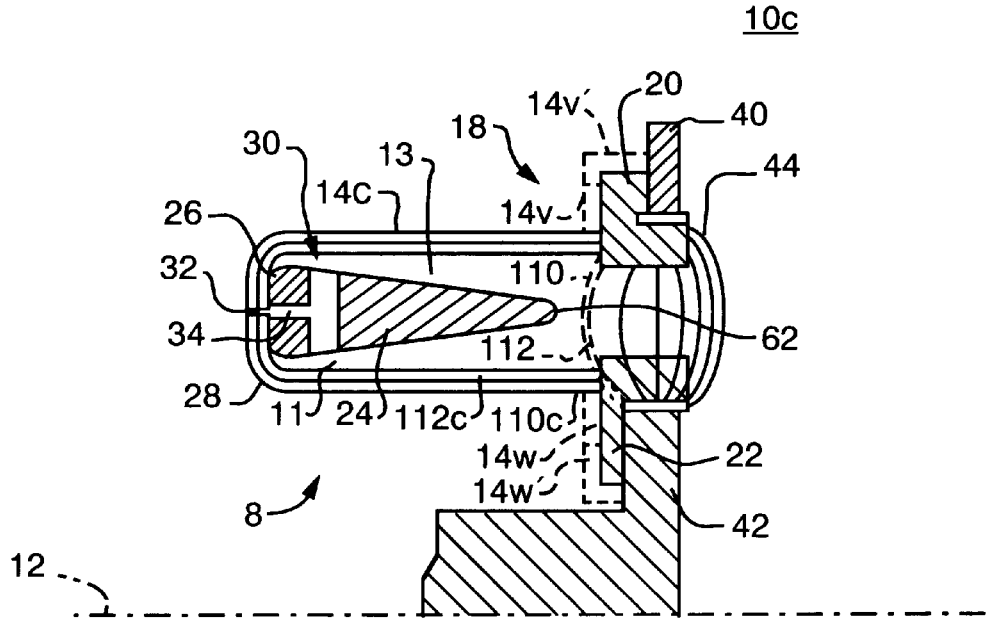
FIG. 6 is a simplified schematic diagram of the plasma accelerator according to this invention with a magnetically conductive composite anode/housing to further shape the magnetic field in the discharge zone.

If the housing 14*c*, FIG. 6, is magnetically conductive, then magnetic lines 110, 112, for example, which would normally fringe as shown in their phantom position, are instead directed or shunted through housing 14 as shown by magnetic lines 110*c* and 112*c*, thereby shifting the peak magnetic field downstream, better controlling the magnetic field distribution and reducing the need for the conventional inner magnetic coil 21 in FIG. 1A, while providing further opportunity to increase performance and thruster life. The ends of housing 14 may be shaped as at 14*v*, 14*w*, FIG. 6, or 14*v*', 14*w*' to achieve desired magnetic field distribution in and downstream of exit port 18.

Figure 7:
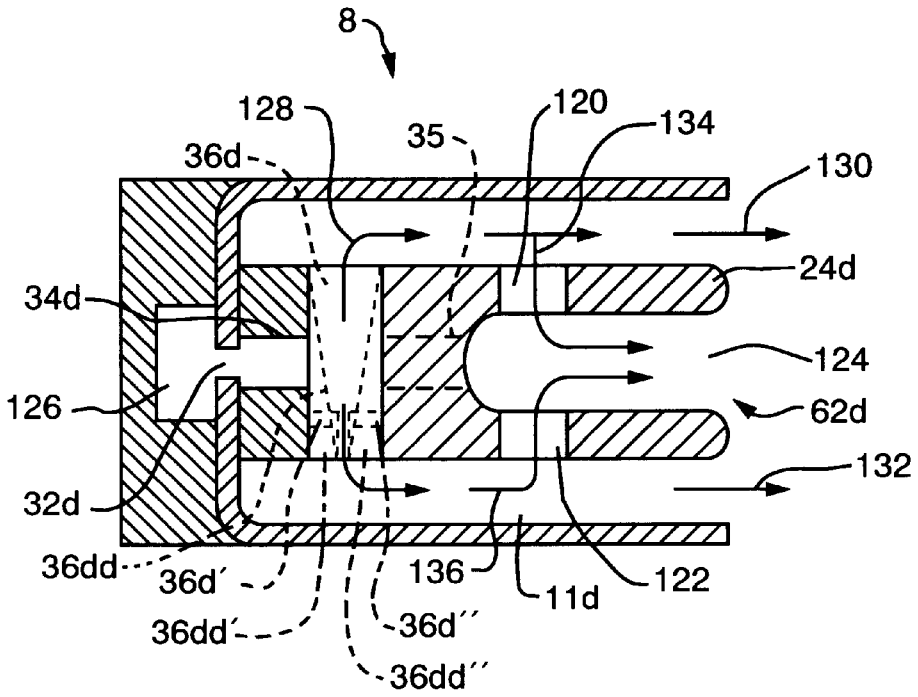
FIG. 7 is a simplified schematic cross-sectional diagram showing another construction of the composite anode and propellant distribution system.

A number of different propellant input distribution systems may be used in accordance with this invention in addition to the one shown in FIG. 1. For example, as shown in FIG. 7 inner anode 24*d* may include input ports 34*d* which communicate with radial passages 36*d* and a second set of passages 120, 122 which communicate with an interior recess 124 at the downstream end of the inner anode 24*d*. Thus the propellant coming from plenum 126 moves through channels 32*d* into input ports 34*d*, then outwardly through passage 36*d* as indicated by arrows 128. When the propellant reaches passages 120 and 122 it now flows axially in the direction shown by arrows 130 and 132 and also flows radially into passages 120 and 122 and out through recess 124 as shown by arrows 134, 136. An additional channel 35 through inner anode 24*d* may be used to supplement or supplant the flow through passages 120, 122 into recess 124. By controlling the radial distribution of the diameter of the radial passages 36*d*, 120, 122 one can control the flow distribution in the radial direction which provides further opportunity to enhance performance and life. In order to control radial propellant distribution radial passages 36*d* may be restricted in one direction or the other as shown by conical passage 36*d*' and stepped or necked passage 36*d*" or the passage may be blocked at one end as shown at 36*dd*".

Figure 8:
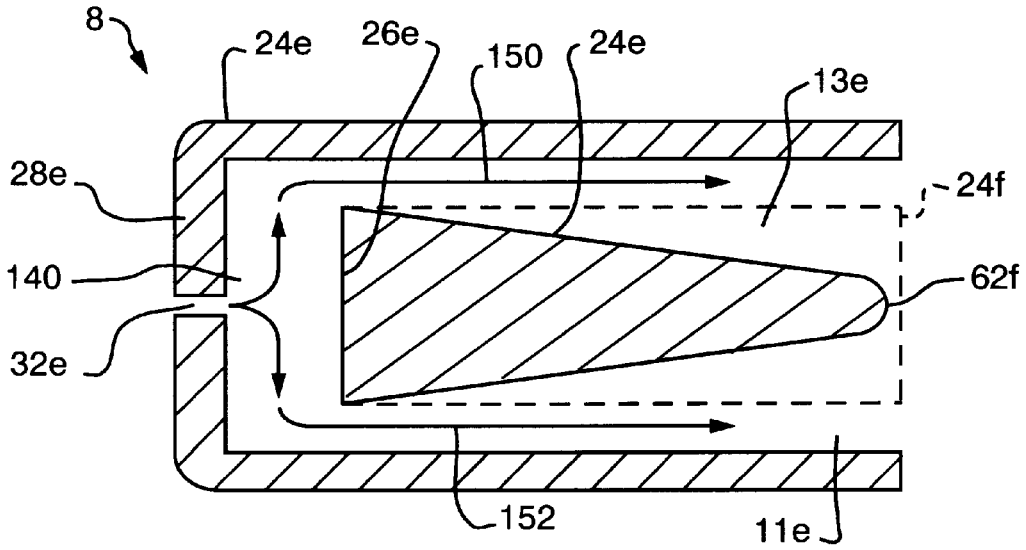
FIG. 8 is yet another construction of the composite anode and propellant distribution system.

In another construction, inner anode 24*e*, FIG. 8, may have its base 26*e* spaced from the base 28*e* of housing 24*e* to create a passage 140 therebetween from which the propellant can be distributed in the zones 11*e*, 13*e* as indicated by arrows 150, 152. Also as shown in FIG. 8, the inner anode is not restricted to a tapered shape of FIGS. 1–6 or the split shape as shown in FIG. 7 may have a more rectangular cross-section 24*f*, FIG. 8, or any other suitable form may be used.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A Hall field plasma accelerator with closed electron drift comprising:

a composite anode including a housing with inner and outer walls forming an outer anode and an inner anode forming inner and outer distribution zones for containing a plasma; said housing being electrically conductive and having an upstream end and an exit port electrically insulated from said housing; said composite anode including an input distribution system for introducing plasma gas into said distribution zones;

pole means for establishing a magnetic field across said exit port; and a cathode for establishing an electron flow through said magnetic field toward said composite anode and creating an electric field through said exit port, said electrons ionizing said plasma gas that is accelerated by the electric field through said exit port.

2. The plasma accelerator of claim 1 in which said inner anode and said housing are electrically connected.

3. The plasma accelerator of claim 1 in which said inner anode and said housing are electrically insulated from each other.

4. The plasma accelerator of claim 1 in which said inner anode and said housing are at different electric potentials.

5. The plasma accelerator of claim 1 in which said distribution system includes a first plurality of input ports in said inner anode and a first number of radial channels extending from said input ports.

6. The plasma accelerator of claim 5 in which said distribution system includes at least one input port in said housing communicating with said first plurality of input ports.

7. The plasma accelerator of claim 5 in which said inner anode has a central recess facing said exit port and there is a second number of radial channels extending outwardly from said central recess through said inner anode.

8. The plasma accelerator of claim 5 in which at least one of the said radial channels is stepped to narrow at one end.

9. The plasma accelerator of claim 5 in which at least one of the said radial channels is blocked at one end.

10. The plasma accelerator of claim 5 in which at least one of the said radial channels is conically tapered to narrow at one end.

11. The plasma accelerator of claim 1 in which the base of said inner anode is spaced from the base of said housing creating a plenum therebetween and said housing includes at least one input port for introducing plasma gas into said plenum.

12. The plasma accelerator of claim 1 in which said housing and said inner anode extend proximate to said exit port for establishing equipotential surfaces within the plasma for defining initial ion trajectories.

13. The plasma accelerator of claim 1 in which said housing and said inner anode extend proximate to said exit port for establishing equipotential surfaces within the plasma for defining a low electric field zone near and beyond the downstream end of said inner anode for reducing the energy of impinging electrons.

14. The plasma accelerator of claim 1 in which said exit port is made of dielectric material.

15. The plasma accelerator of claim 1 in which said exit port is made of alternate layers of dielectric and conductor material.

16. The plasma accelerator of claim 1 in which said exit port includes a sputter resistant material for protecting said pole means.

17. The plasma accelerator of claim 16 in which said sputter resistant material is diamond.

18. The plasma accelerator of claim 16 in which said sputter resistant material is graphite.

19. The plasma accelerator of claim 1 in which said housing, said exit port and said pole means are thermally connected for improved heat rejection.

20. The plasma accelerator of claim 1 in which said housing is thermally isolated from said exit port to minimize input gas heating.

21. The plasma accelerator of claim 1 in which said housing has a width equal to or larger than said exit port for providing a reservoir of propellant, greater uniformity of propellant distribution and more uniform plasma for improved life, performance and reduced discharge fluctuations.

22. The plasma accelerator of claim 1 in which said housing and said inner anode extend proximate to said exit port for establishing equipotential surfaces within the plasma and a low electric field zone near and beyond said downstream end of said inner anode for inducing the electrons to traverse the paths of neutrals to increase probability of collision and enhance ionization.

23. The plasma accelerator of claim 22 in which said housing is in electrical contact with said plasma gas.

24. The plasma accelerator of claim 1 in which at least parts of said composite anode are made of a magnetic material for shunting fringing portions of said magnetic field and controlling the magnetic field distribution in the plasma for improved performance and life.

25. The plasma accelerator of claim 1 in which said housing, said exit port and said pole means are in physical contact.

26. The plasma accelerator of claim 1 further including at least one magnetic field source for providing a magnetic field through said poles.

27. The plasma accelerator of claim 26 in which said composite anode is annular and said magnetic field source is disposed radially outwardly of said composite anode.

28. The plasma accelerator of claim 26 in which said composite anode is annular and said magnetic field source is disposed radially inwardly of said composite anode.

29. The plasma accelerator of claim 26 in which said composite anode is annular and said magnetic field source is disposed radially inwardly and outwardly of said composite anode.

30. The plasma accelerator of claim 26 in which said composite anode is annular and said magnetic field source is disposed upstream or radially outwardly of the composite anode and coaxially with it.

31. The plasma accelerator of claim 1 in which said exit port is circularly annular.

32. The plasma accelerator of claim 1 in which said exit port is non-circularly annular.

33. The plasma accelerator of claim 1 in which said exit port is chamfered to reduce sputtering.

34. A hall field plasma accelerator with closed electron drift comprising:

a composite anode including a housing with inner and outer walls forming an outer anode and an inner anode forming inner and outer distribution zones; said housing being electrically conductive and having an upstream end and an exit port electrically insulated from said housing; said composite anode including an input distribution system for introducing plasma gas into said distribution zones;

pole means for establishing a magnetic field across said exit port; and a cathode for establishing an electron flow through said magnetic field toward said composite anode and creating an electric field through said exit port, said electrons ionizing said plasma gas that is accelerated by the electric field through said exit port;

said distribution system including a first plurality of input ports in said inner anode and a first number of radial channels extending from said input ports, said inner anode having a central recess facing said exit port and a second number of radial channels extending outwardly from said recess through said inner anode.

35. A hall field plasma accelerator with closed electron drift comprising:

a composite anode including a housing with inner and outer walls forming an outer anode and an inner anode forming inner and outer distribution zones; said housing being electrically conductive and having an upstream end and an exit port electrically insulated from said housing; said composite anode including an input distribution system for introducing plasma gas into said distribution zones;

pole means for establishing a magnetic field across said exit port; and a cathode for establishing an electron flow through said magnetic field toward said composite anode and creating an electric field through said exit port, said electrons ionizing said plasma gas that is accelerated by the electric field through said exit port;

said housing has a width equal to or larger than said exit port for providing a reservoir of propellant, greater uniformity of propellant distribution and more uniform plasma for improved life, performance and reduced discharge fluctuations.

36. A hall field plasma accelerator with closed electron drift comprising:

a composite anode including a housing with inner and outer walls forming an outer anode and an inner anode forming inner and outer distribution zones; said housing being electrically conductive and having an upstream end and an exit port electrically insulated from said housing; said composite anode including an input distribution system for introducing plasma gas into said distribution zones;

pole means for establishing a magnetic field across said exit port; and a cathode for establishing an electron flow through said magnetic field toward said composite anode and creating an electric field through said exit port, said electrons ionizing said plasma gas that is accelerated by the electric field through said exit port;

where at least parts of said composite anode are made of a magnetic material for shunting fringing portions of said magnetic field and controlling the magnetic field distribution in the plasma for improved performance and life.

37. A hall field plasma accelerator with closed electron drift comprising:

a composite anode including a housing with inner and outer walls forming an outer anode and an inner anode forming inner and outer distribution zones; said housing being electrically conductive and having an upstream end and an exit port electrically insulated from said housing; said composite anode including an input distribution system for introducing plasma gas into said distribution zones;

pole means for establishing a magnetic field across said exit port; and a cathode for establishing an electron flow through said magnetic field toward said composite anode and creating an electric field through said exit port, said electrons ionizing said plasma gas that is accelerated by the electric field through said exit port;

said distribution system including a first plurality of input ports in said inner anode and a first number of radial channels extending from said input ports, at least one of said radial channels is conically tapered to narrow at one end.

38. A hall field plasma accelerator with closed electron drift comprising:

a composite anode including a housing with inner and outer walls forming an outer anode and an inner anode forming inner and outer distribution zones; said housing being electrically conductive and having an upstream end and an exit port electrically insulated from said housing; said composite anode including an input distribution system for introducing plasma gas into said distribution zones;

pole means for establishing a magnetic field across said exit port; and a cathode for establishing an electron flow through said magnetic field toward said composite anode and creating an electric field through said exit port, said electrons ionizing said plasma gas that is accelerated by the electric field through said exit port;

said distribution system including a first plurality of input ports in said inner anode and a first number of radial channels extending from said input ports, at least one of said radial channels is stepped to narrow at one end.

* * * * *